US005288145A

United States Patent [19]

Mackey et al.

[11] Patent Number: 5,288,145

[45] Date of Patent: Feb. 22, 1994

[54] MIXING AND DILUTING APPARATUS

[75] Inventors: Glenn C. Mackey, Rockford; William H. Lucas, Dakota, both of Ill.

[73] Assignee: M.C. Chemical Co., Rockford, Ill.

[21] Appl. No.: 68,414

[22] Filed: May 27, 1993

[51] Int. Cl.[5] ..... B01F 15/04

[52] U.S. Cl. ..... 366/152; 222/58; 366/141

[58] Field of Search ..... 366/141, 151, 152, 153, 366/160, 161, 162, 601, 18, 33; 222/57, 58

[56] References Cited

U.S. PATENT DOCUMENTS 4,362,033 12/1982 Young ..... 366/152
4,403,866 9/1983 Falcoff ..... 366/152
4,830,508 5/1989 Keizo ..... 366/141
5,110,521 5/1992 Moller ..... 366/141

*Primary Examiner*—Robert W. Jenkins
*Attorney, Agent, or Firm*—Leydig, Voit & Mayer

[57] ABSTRACT

Apparatus for automatically mixing a predetermined weight of liquid having a high concentration of solids with water in order to dilute the concentrate. A programmable controller is adapted to be programmed with the desired weights of concentrate and water for the mixture and responds to signals from a weighing scale to automatically cut off the flow of each material into a mixing tank when the proper weight of each material has been delivered into the tank.

2 Claims, 2 Drawing Sheets

MIXING AND DILUTING APPARATUS

BACKGROUND OF THE INVENTION

This invention relates generally to apparatus for mixing materials and, more particularly, to apparatus for mixing water with a concentrated liquid slurry in order to dilute the slurry.

During an intermediate stage in the manufacture of tires, rubber is formed either into slabs or pellets which are temporarily stored. To keep the material from sticking together, the slabs and pellets must be coated with an anti-stick substance, the slabs being dipped and the pellets being sprayed. Initially, the tire manufacturer creates the anti-stick material by dumping bags of powdered chemical into water in a large tank to create a concentrated slurry having a solids content ranging from 40–70 percent by weight. Subsequently, the slurry is diluted and is applied to the rubber slabs or pellets. In the case of slabs, the solids content of the diluted slurry may be as low as 3–5 percent by weight. Pellets, however, must be coated with a more concentrated slurry, for example, a slurry having a solids content of 13–15 percent by weight.

In typical tire manufacturing operations, the diluted slurry is created under manual control with a human operator being responsible for mixing the proper weight of highly concentrated slurry with the proper weight of water. Due to human error, diluted slurries of inaccurate proportions are inherently produced from time-to-time. Also, the mixing and diluting process is labor-intensive.

SUMMARY OF THE INVENTION

The general aim of the present invention is to provide new and relatively simple and inexpensive programmable mixing/diluting apparatus in which precisely proper weights of constituent materials are automatically introduced into a mixing tank at proper intervals.

A more detailed object of the invention is to achieve the foregoing by providing mixing apparatus having a programmable controller which automatically operates to cut off the flow of one material to the tank after a predetermined weight of that material has been introduced into the tank, to thereafter initiate the flow of the second material into the tank, and to cut off that flow when a predetermined weight of the second material has been introduced into the tank.

The invention also resides in the ability of the controller to initiate another mixing cycle after a predetermined weight of the previously mixed mixture has been discharged from the mixing tank.

These and other objects and advantages of the invention will become more apparent from the following detailed description when taken in conjunction with the accompanying drawings.

DETAILED DESCRIPTION OF THE PREFERRED EMBODIMENT

Figure 1:
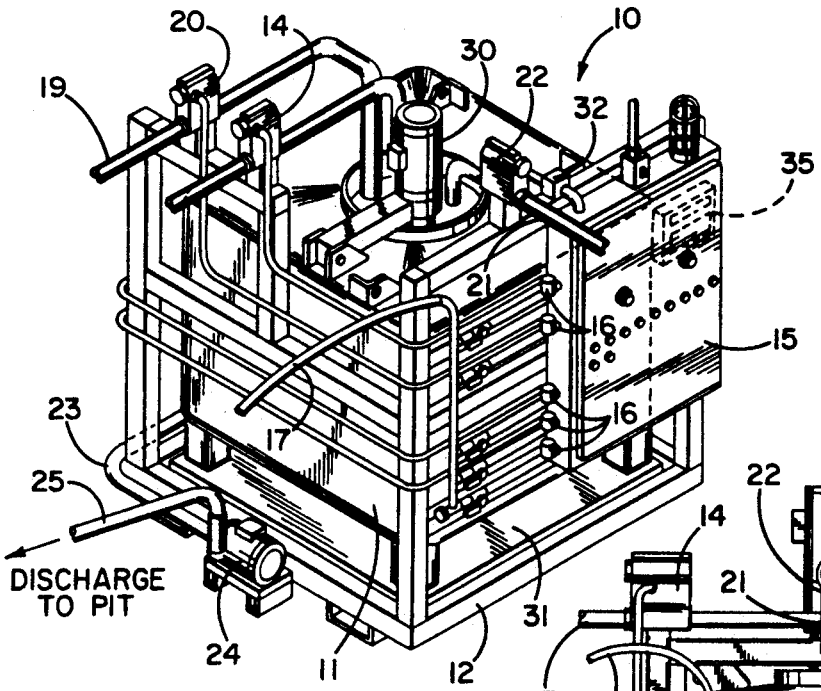
FIG. 1 is a perspective view of new and improved mixing and diluting apparatus incorporating the unique features of the present invention.

For purposes of illustration, the invention has been shown in the drawings as embodied in apparatus 10 for mixing various materials, one of which is liquid and the other of which is at least partially liquid. Herein, the apparatus is specifically used to mix water with a liquid concentrate having a relatively high solids content in order to dilute the concentrate and produce a liquid slurry having a significantly lower solids content. An appropriate additive may be introduced into the mixture if desired.

More specifically, the mixture produced by the apparatus 10 is used to coat the rubber (e.g., rubber slabs or pellets) used in the manufacture of tires in order to prevent the slabs and pellets from sticking together during storage. In one particular example, the initial concentrate is formed by dumping sacks of powder such as calcium carbonate into water in a large storage tank (not shown) to create a liquid concentrate having a solids content of about 55 percent by weight. Subsequently, the concentrate is mixed with additional water and optionally with an appropriate additive such as a thickener to form a diluted slurry for use in coating the rubber. When the diluted slurry is used in conjunction with pellets, it usually has a solids content ranging between 13 and 15 percent by weight and is sprayed on the pellets. Slurry used with slabs is applied by dipping the slabs into the slurry and has a lower solids content such as 3–5 percent by weight.

The present invention contemplates the provision of relatively simple apparatus 10 for mixing the concentrate and water in very accurate proportions, the apparatus operating automatically and with need of very little human supervision. As a result, the danger of producing an improperly formulated slurry is virtually eliminated and, in addition, labor costs are significantly reduced.

More specifically, the apparatus 10 includes a mixing tank 11 supported within a main box-like frame 12. Concentrate from the large storage tank is supplied to the tank 11 by way of a pipe 13 with the flow being controlled by an air-actuated on/off relay valve 14 in the pipe. The valve 14 is controlled by one of five pilot valves (not visible) in a control panel 15 on the front of the frame 12, each pilot valve being controlled by an electrically actuated solenoid 16 and being supplied with pressurized air via a line 17.

Water is selectively introduced into the tank 11 by means of a pipe 19 with a relay valve 20 which is opened and closed in response to energization and de-energization, respectively, of another one of the solenoids 16. A third pipe 21 with a third relay valve 22 selectively admits additive into the tank when a third solenoid is energized.

Figure 2:
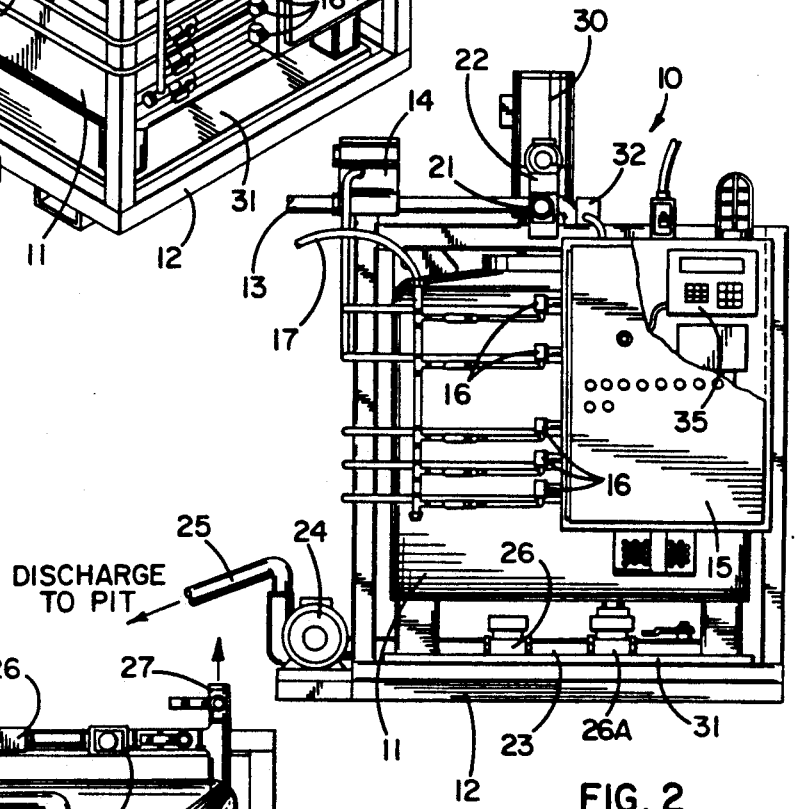
FIGS. 2 and 3 are front elevation and top plan views, respectively, of the apparatus shown in FIG. 1.
Figure 3:
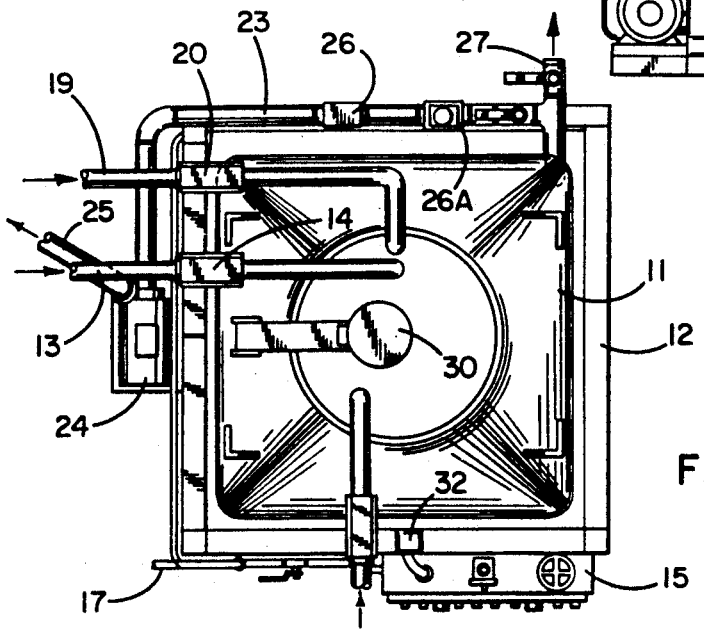

A discharge pipe 23 leads from the bottom of the tank 11 to the inlet of a motor-operated pump 24 whose outlet communicates by way of a pipe 25 with a large reservoir 40 (FIG. 4) located in a pit below the apparatus 10. Two relay valves 26 and 26A (FIG. 2) are associated with the discharge line 23 and are controlled by the remaining two solenoids 16. A manually operable drain valve 27 (FIG. 3) is connected into the line 23 upstream of the valves 26 and may be opened for purposes of cleaning the tank.

From a mechanical standpoint, the apparatus 10 is completed by a motor-operated mixer 30, by a digital weighing unit 31 and by an overflow sensor 32. The mixer 30 is located at the center of the tank 11 and serves to blend the concentrate, the additive and the water. The weighing unit or scale 31 underlies the tank and produces an electrical signal (preferably in digital form) which is representative of the instantaneous weight of the materials in the tank. The overflow sensor 32 includes a float-operated switch which, when triggered, causes the valves 26 and 26A to open and the pump 24 to kick in so as to deliver excess slurry to the lower reservoir 40.

In carrying out the invention, a programmable controller 35 is located within the control panel 15 and may be programmed with the desired weights of concentrate, water and additive to be introduced into the tank 11. The controller 35 responds to the instantaneous weight signal from the scale 31 and effects opening and closing of the valves 14, 20 and 22 at appropriate times so as to cause the desired weights of materials to be introduced into the tank.

To explain the operation of the apparatus 10, let it be assumed that the tank 11 is empty and that a particular formulation calls for 2,000 lbs. of water, 10 lbs. of additive and 340 lbs. of concentrate. The operator programs the respective weights into the controller 35 (see FIG. 5) and then actuates a start switch to initiate a cycle. Thereupon, the controller energizes the solenoid 16 associated with the relay valve 20 and thereby opens that valve to start adding water to the tank via the line 19. After a small but predetermined weight of water has been supplied to the tank, the controller responds to the signal from the scale 31 to effect energization of the motor of the mixer 30. After 2,000 lbs. of water have been added to the tank, the controller again responds to the signal from the scale and de-energizes the first solenoid 16 and energizes a second solenoid so as to close and open the valves 20 and 22, respectively. Thus, the flow of water to the tank is cut off while the flow of additive is initiated by way of the pipe 21.

When the signal from the scale 31 indicates that the total weight of the material in the tank 11 is 2,010 lbs., the controller 35 de-energizes the second solenoid 16 and energizes a third solenoid so as to effect closing of the valve 22 and opening of the valve 14. The latter valve remains open and concentrate is added to the tank 11 via the pipe 13 until the scale signals that the total material weight in the tank is 2,400 lbs. The controller 35 then effects de-energization of the third solenoid so as to cause closing of the valve 14. After that valve is closed, the mixer 30 continues to operate for a predetermined period of time (e.g., 2 minutes) and then is shut down by the controller. Thereafter, the controller effects opening of the discharge valve 26.

Figure 4:
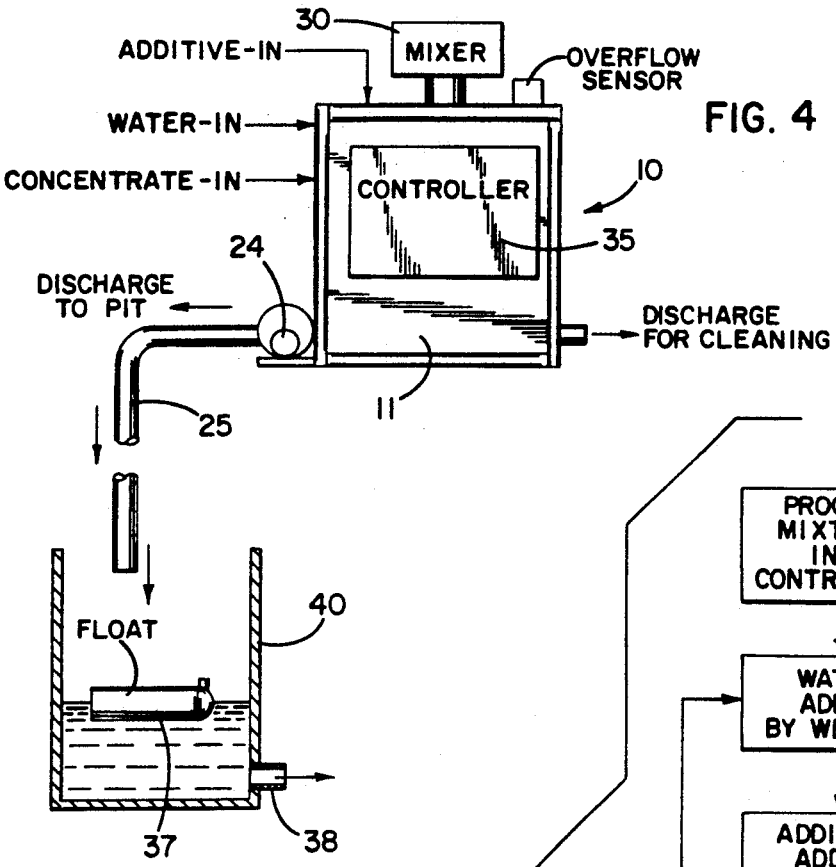
FIG. 4 is a diagrammatic view of the apparatus in a typical operating environment.
Figure 5:
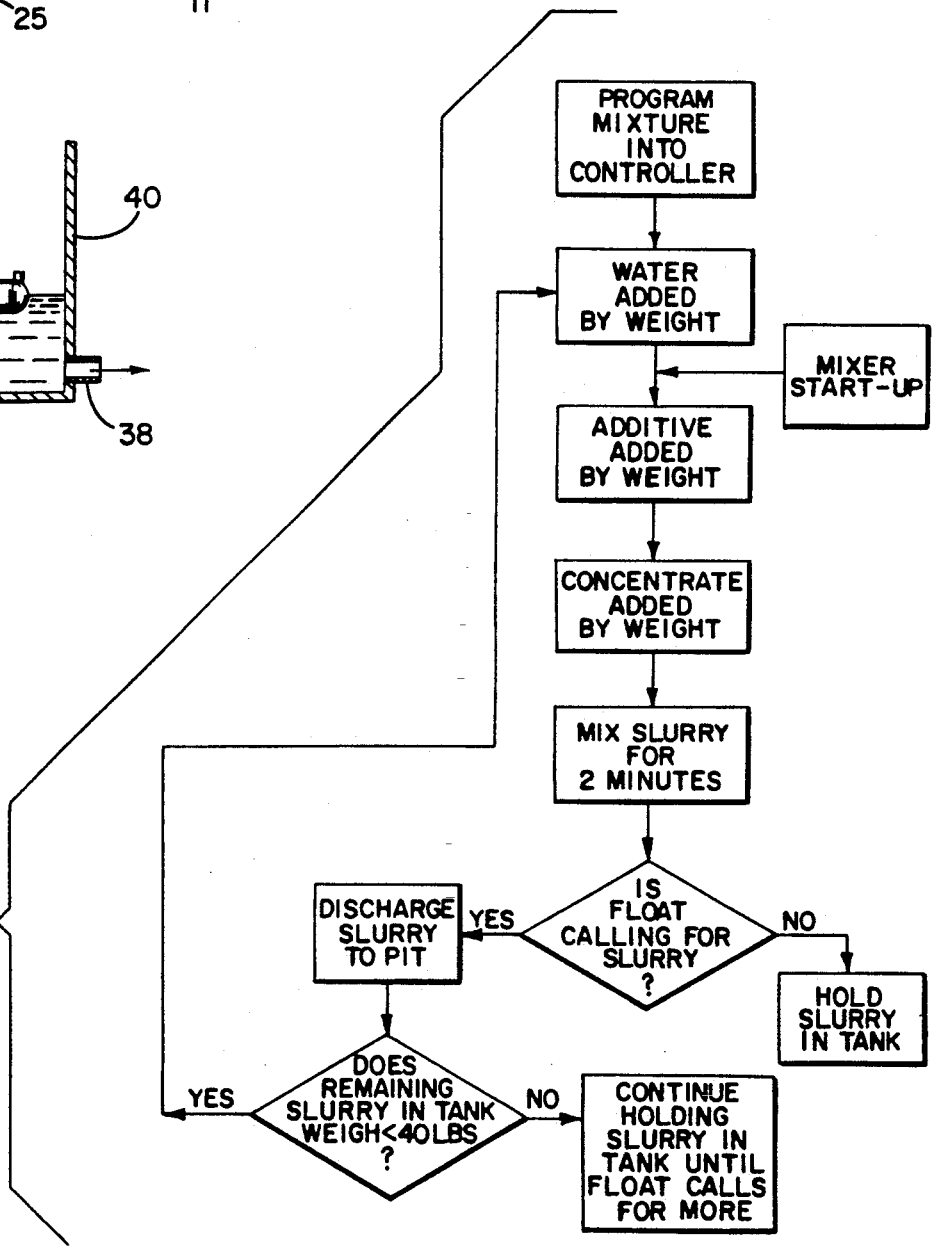
FIG. 5 is a flow chart which shows the operational sequence of the apparatus.

Referring particularly to FIGS. 4 and 5, if the slurry supply in the reservoir 40 is low, a float 37 in the reservoir transmits a signal to the solenoid 16 for the discharge valve 26A and also to the controller 35 to effect opening of the valve 26A and start-up of the pump 24 and thereby cause slurry to be delivered from the tank 11 to the reservoir 26 via the lines 23 and 25. Usually, the pump delivers between 125–200 lbs. of slurry to the reservoir before the float transmits a signal to stop the pump and close the valve 26A. The remaining slurry then is held in the tank 11 while slurry is discharged through an outlet pipe 38 in the reservoir to the rubber coating operation. When the slurry level in the reservoir drops, the float 37 again transmits a signal to effect re-opening of the valve 26A and re-starting of the pump 24.

The discharge cycle described above is repeated until only a small quantity (e.g., 40 lbs.) of slurry remains in the tank 11. At this time, the scale 31 signals the controller 35 to close the discharge valve 26 and start another mixing cycle, at which time the steps described previously are repeated. If the float 37 calls for slurry while the next batch is being mixed, the closed valve 26 prevents a partially mixed blend from being discharged to the reservoir 40.

From the foregoing, it will be apparent that the present invention brings to the art new and improved apparatus 10 which automatically blends accurate weights of materials to obtain an accurately proportioned blend. Once the apparatus is started, it requires virtually no human supervision other than occasional routine monitoring or unless the proportions of the blend are changed during the course of a work shift. Such change can be effected simply by reprogramming the controller 35 so as to switch between a very highly diluted mixture for rubber slabs and a less diluted mixture for pellets.

Those familiar with the art will appreciate that, in some cases, the pump 24 may be eliminated and the slurry discharged from the tank 11 by gravity. In such a case, the float 37 need be connected only to the solenoid for the discharge valve 26A and need not be connected to the controller 35.

We claim:

1. Apparatus for mixing a first liquid material with a second at least partially liquid material, said apparatus comprising a mixing tank, first and second electrically controlled valves for regulating the flow of said first and second materials, respectively, to said tank, means for detecting the instantaneous weight of material in said tank and for producing an electrical signal representative of such weight, electrically controlled power operated means for mixing the first and second materials in said tank, controller means adapted to be programmed with the desired weight of each of said materials to be added to said tank, said controller means:

(A) causing one of said valves to open and admit one of said materials to said tank through said one valve;

(B) causing said power-operated means to start;

(C) responding to said signal and causing said one valve to close and causing the other valve to open when the weight of said one material in said tank reaches the desired weight whereby the other of said materials is then admitted into said tank through said other valve;

(D) responding to said signal and causing said other valve to close when the weight of the other material in said tank reaches the desired weight; and (E) causing said power-operated means to stop a predetermined time after closure of said other valve.

2. Apparatus as defined in claim 1 further including means for causing the mixed material to be discharged from said tank, said controller means responding to said signal and re-opening said one valve when the weight of material in said tank drops to a predetermined value.

* * * * *